US006234136B1

(12) United States Patent
Choi et al.

(10) Patent No.: US 6,234,136 B1
(45) Date of Patent: May 22, 2001

(54) NOISE REDUCING OIL PAN FOR AUTOMOTIVE ENGINE

(75) Inventors: Michael Choi, Garden City; Mike K. Rao, Novi, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/507,831

(22) Filed: Feb. 22, 2000

(51) Int. Cl.[7] ..... F02F 7/00; F02B 77/13
(52) U.S. Cl. ..... 123/195 C; 123/198 E
(58) Field of Search ..... 123/195 C, 198 E; 181/290, 204

(56) References Cited

U.S. PATENT DOCUMENTS

| | | | | |
|---|---|---|---|---|
| 3,647,022 | | 3/1972 | Meyer et al. | 181/290 |
| 3,991,735 | | 11/1976 | Horstmann | 123/195 C |
| 4,270,497 | * | 6/1981 | Valerio | 123/195 C |
| 4,432,433 | | 2/1984 | Ogawa | 181/204 |
| 4,522,165 | | 6/1985 | Ogawa | 123/195 C |
| 4,683,979 | | 8/1987 | Ghibu et al. | 181/286 |
| 4,773,366 | * | 9/1988 | Seidl et al. | 123/196 R |
| 4,851,271 | | 7/1989 | Moore, III et al. | 428/34.5 |
| 5,024,189 | * | 6/1991 | Ushio et al. | 123/195 R |
| 5,103,782 | * | 4/1992 | Matsui | 123/195 C |
| 5,357,922 | * | 10/1994 | Han | 123/195 H |
| 5,452,692 | * | 9/1995 | Spray et al. | 123/195 C |
| 5,452,693 | * | 9/1995 | Clark | 123/195 C |
| 5,465,692 | * | 11/1995 | Uraki et al. | 123/195 C |
| 5,499,908 | | 3/1996 | Schmitz, III | 417/368 |
| 6,041,751 | * | 3/2000 | Kuriyama et al. | 123/195 C |

OTHER PUBLICATIONS

Authors– Uraki, Kondo, Yashiro "Development of a Technique for Uning Oil Viscosity to Reduce Noise Radiated from the Oil Pan" May 17, 1999; pp. 835–841 Society of Automotive Engineers, Inc. SAE 1999–01–1759.

* cited by examiner

*Primary Examiner*—Noah P. Kamen
*Assistant Examiner*—Hai Huynh
(74) *Attorney, Agent, or Firm*—Jerome R. Drouillard

(57) ABSTRACT

A noise reducing oil pan assembly for a motor vehicle engine, adapted for attachment to the engine block underside, includes outer and inner nested pan units supported in spaced relation defining an oil chamber between the units. An inflow gap between the upper opposed edge portions of the units upstanding walls is positioned subjacent the outflow of engine block return oil passages. With the engine running, the return oil flow fills the chamber and thereafter the overflow is received by the inner unit reservoir for re-circulation to the engine. The chamber oil provides a barrier that dampens engine noise radiating from the oil pan assembly.

10 Claims, 3 Drawing Sheets

NOISE REDUCING OIL PAN FOR AUTOMOTIVE ENGINE

FIELD OF THE INVENTION

The present invention relates to oil pans for internal combustion engines and, more specifically, to an engine noise dampening oil pan assembly.

BACKGROUND OF THE INVENTION

In the desire to reduce noise emitted from internal combustion engines oil pans, various sound dampening arrangements have been proposed. U.S. Pat. No. 4,851,271, discloses a laminated oil pan structure of a thin plastic damping material positioned between flat inner surfaces of the pan and stamped steel insert pan liners.

An engine sound deadening arrangement is disclosed in U.S. Pat. No. 3,991,735, which provides a liquid sound barrier in the form of an oil reservoir between a cylinder block walls and cowling cover.

The Society of Automotive Engineers, Inc. paper No. 1999-01-1759, entitled: "Development of a Technique for Using Oil Viscosity to Reduce Noise Radiated from the Oil Pan", discloses a vibration dampening technique for engine oil pans to reduce radiation noise. Damping is obtained with a "squeeze" oil pan, formed with a thin oil film between the pan and an added inner plate, which reduces the pan vibration level to lower radiation noise.

SUMMARY OF THE INVENTION

Accordingly, the present invention concerns an oil pan assembly for automotive internal combustion engine blocks formed with passages for returning oil to an oil pan reservoir. Applicant's pan assembly comprises a pair of corresponding inner and outer pan units, wherein the inner unit is supported in nested spaced relation within the outer unit. The space between unit walls provides a return oil chamber, with the upper opposed edge portions of its walls defining oil inflow gaps. The chamber substantially envelops the inner pan unit oil reservoir, allowing the chamber oil to dampen engine noise radiating from the reservoir.

Another feature of the invention set forth above is to provide an oil pan assembly wherein, with its outer pan unit being secured to the bottom of the engine block, the chamber inflow gaps are located subjacent the return oil flows exiting the block oil passages. Upon filling the chamber, the return oil overflows into the inner pan unit reservoir for re-circulation to the engine.

Still another feature is to provide a duel-walled oil pan assembly as set forth above, wherein the assembly is fabricated from thinner gauge sheet steel such that its weight is substantially the same as conventional oil pans formed from thicker gauge sheet steel. In the disclosed embodiment the inner and outer nested metal pan units are secured together in a spaced manner by a plurality of welded spacer members, defining a "honeycomb panel" type, dual wall structure.

It is yet another feature to terminate the inner wall upper edge portion in an upwardly facing convex curved lip for directing the return oil flow from the block passages into the chamber. After the chamber is filled with oil, the convex lip provides an overflow path for returning the oil to the pan unit reservoir.

BRIEF DESCRIPTION OF THE DRAWINGS

The features and advantages described herein will be more fully understood by reading an example of one embodiment in which the invention is used to advantage, referred to herein as the Description of the Preferred Embodiment, with reference to the drawings wherein.

DETAILED DESCRIPTION OF THE PREFERRED EMBODIMENT

Figure 1:
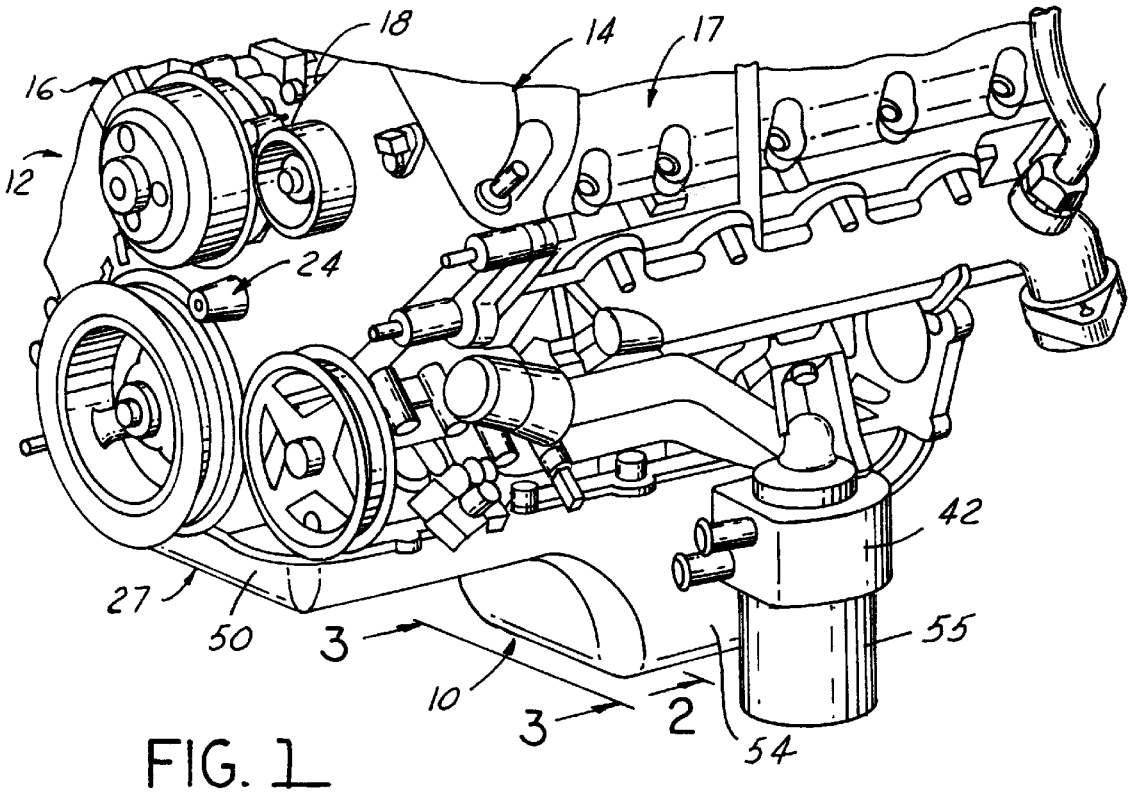
FIG. 1 is a fragmentary, perspective view of a conventional V-configuration internal combustion engine provided with an oil pan assembly, according to the present invention.

Referring to FIG. 1 of the drawings, an embodiment of an oil pan assembly 10 is shown attached beneath a "V" configuration internal combustion engine, indicated generally at 12. Engine cylinder block 14, which supports right-hand and left-hand banks of cylinders, 16 and 17 respectively, are shown separated by block valley 18 in the form of a "V". The block is formed with oil lubricating passages (not shown), and gravity flow oil return passages, exemplified by passage 19 in FIG. 2.

Figure 2:
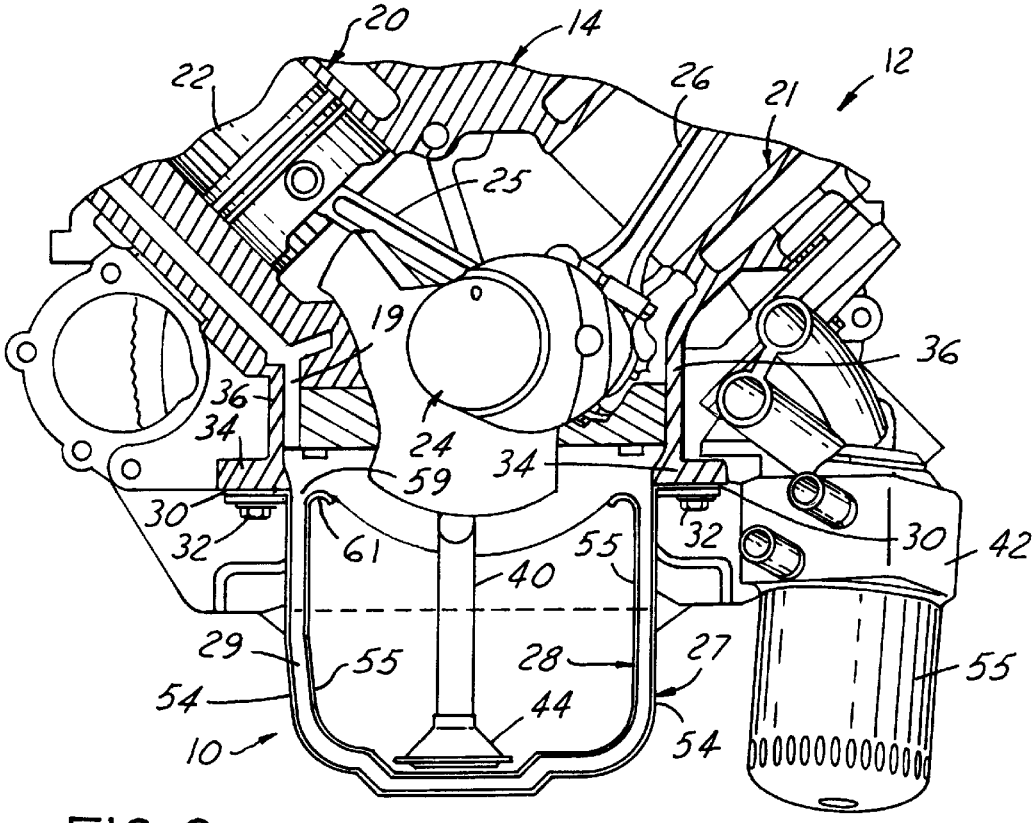
FIG. 2 is an enlarged fragmentary cross sectional view, partly in elevation, taken substantially on line 2—2 of FIG. 1, showing a lower portion of the engine crankcase supporting the oil pan assembly of the present invention.

As viewed in FIG. 2, right and left cylinders are partially shown at 20 and 21, respectively. It should be noted that while a V type engine is shown other engines, such as an in-line four cylinder engine for example, could be equipped with the oil pan assembly 10. The cylinder 20 has its piston 22 joined to engine crankshaft 24 by connecting rod 25, while the cylinder 21 has a piston (not shown) joined by connecting rod 26 to the crankshaft.

Figure 3:
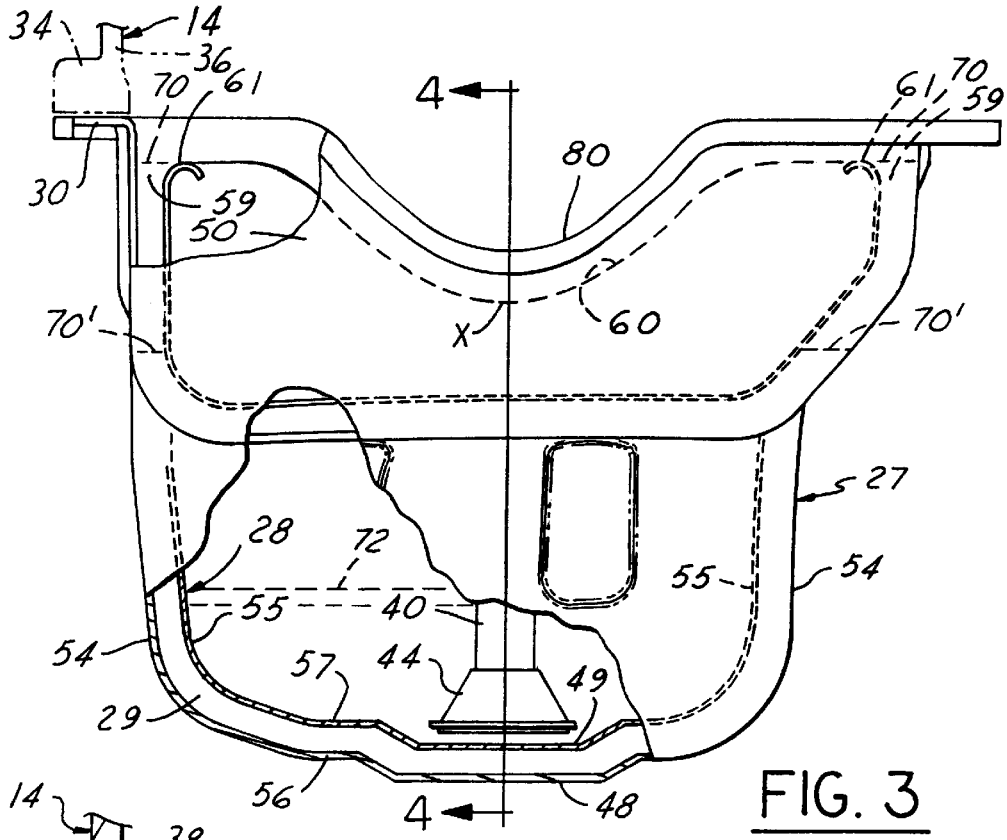
FIG. 3 is an enlarged elevation view, with parts broken away, of the forward end of the oil pan assembly, as viewed from line 3—3 of FIG. 1.
Figure 5:
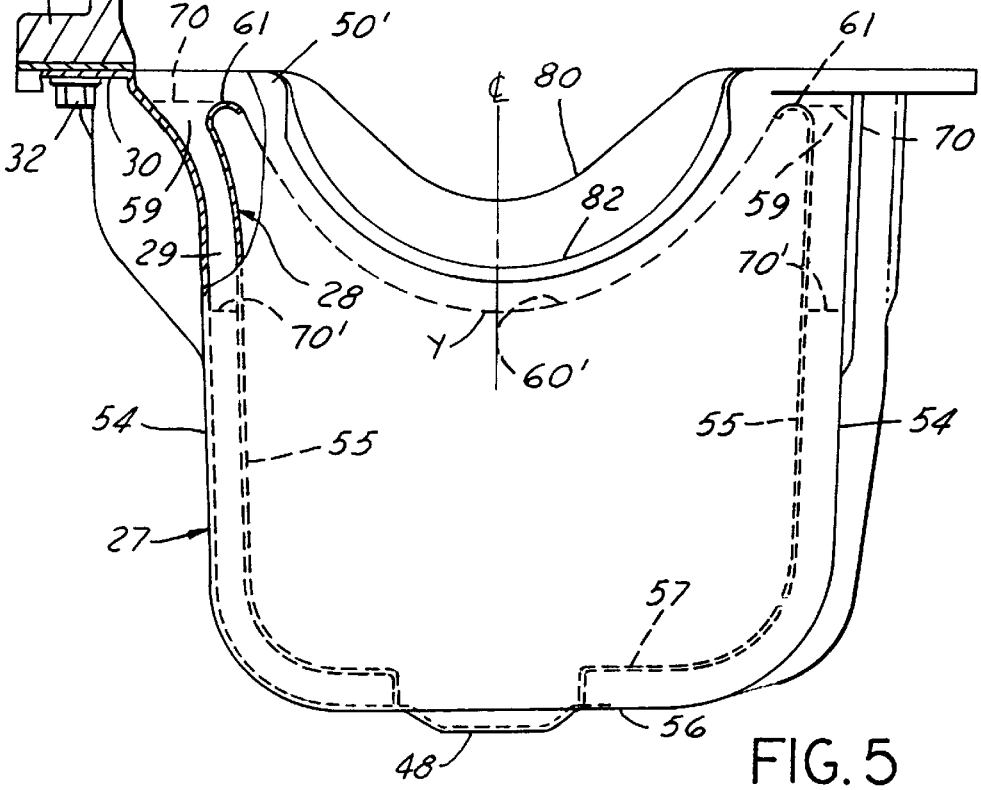
FIG. 5 is an enlarged elevation view, with parts broken away, of the aft end of the pan assembly.
Figures 4, 4A, 4B:
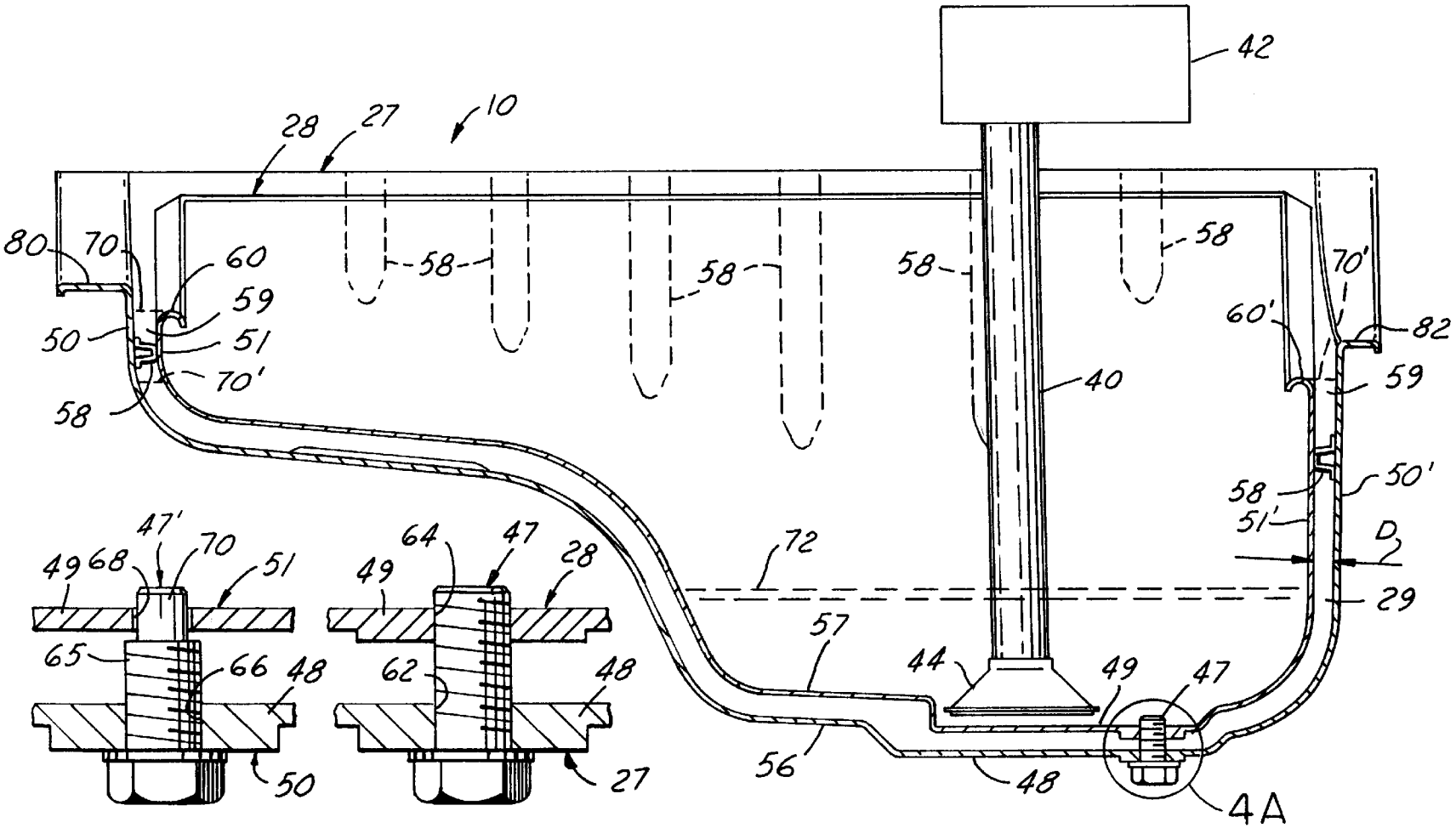
FIG. 4 is a cross sectional view, partly in elevation, taken on the line 4—4 of FIG. 3.
FIG. 4A is an enlarged fragmentary cross sectional view, partly in elevation, of the drain plug of the FIG. 4, of the area enclosed by circle "4A"
FIG. 4B is a view similar to FIG. 4A showing a modified drain plug arrangement.

The pan assembly 10 comprises an outer pan unit 27 and an inner substantially matching pan unit 28 of reduced size. As illustrated in FIGS. 2, 3 and 5, the outer pan unit 27 is attached to the block underside by laterally extending side flanges 30—30 suitably secured, as by bolts 32—32, to outboard lower extensions 34—34 of block walls 36—36. A lubricant pick-up tube 40, connected to lubricant pump 42, terminates at its lower end in a-cone-shaped return-oil filter screen 44. FIG. 4 shows the tube screen 44 located adjacent a threaded screw-in drain plug 47 for depressed sump areas 48 and 49, of associated outer and inner pan units 27 and 28, in a manner to be discussed.

With reference to FIGS. 3–5, the outer pan unit 27 is larger in size relative to its complementary-shaped inner pan unit 28, enabling pan unit 28 to be supported in a nested, spaced manner within outer unit 27. The outer and inner units define an oil chamber 29 there-between, which chamber substantially envelops the oil reservoir formed by the inner unit 28. Although the oil pan units 27 and 28 are each formed with a generally rectangular box shape, other configurations, such as a cylindrical-shaped pan for example, are within the scope of the invention. The outer pan unit 27 includes front 50 and aft 50' end walls, side walls 54—54, and bottom wall 56 uniformly spaced apart from associated inner pan unit front 51 and aft 51' end walls, side walls 55—55, and bottom wall 57 by a predetermined dimension "D". In the disclosed embodiment the dimension "D" is of the order of 5 mm.

The inner pan unit 28 is fixedly supported, in a rigid manner, relative to the outer unit 27 by suitable spacer segments secured, as by spot-welding, to the inner and outer sheet steel pan units 27 and 28. In the disclosed form the spacer segments comprise a plurality of elongated hat-sectioned segments, shown at 58 in FIG. 4. Relative to the weight factor, the dual walled oil pan assembly 10 allows the use of thinner gauge sheet steel for both units 27 and 28. In the instant embodiment the pan assembly 10 replaces a prior art oil pan requiring a sheet steel gauge thickness of the order of 1.5 mm. The pan assembly outer unit 27 sheet steel has a reduced gauge thickness of about thirty percent (1.05 mm), while the inner unit 28 sheet steel has a reduced gauge thickness of about sixty percent (0.60 mm). Thus, applicant's pan assembly has a combined weight that is closely comparable to prior art oil pans of equal size.

It is understood that other spacer arrangements methods may be employed such as, for example, forming stamped dimples in the walls of one pan unit adapted for spot-welding to opposed walls of the other pan unit. Also, the pan units may be fabricated from other materials such as fiberglass, for example, without departing from the invention.

FIGS. 1 and 2 disclose portions of a conventional vehicle engine lubricating system. Thus, with the engine running, oil pump 42 pulls returned motor oil out of the inner unit reservoir 28, via pickup tube 40, after the oil has been passed through filter screen 44. Pump pressure then pushes the oil through filter 55 and engine block passages (not shown), after which the filtered oil flows to the engine and lubricates its moving parts. The oil drains back through a plurality of block gravity return oil passages, such as the passage 19 in FIG. 2, and thereafter flows into a pan reservoir for re-circulation back to the engine.

In FIG. 1, with the engine running, the gravity flow of return oil exits block passage 19 for entry into an associated subjacent inflow gap 59, defined by upper edge portions of the opposed side walls 54 and 55, filling the pan-shaped chamber 29. It will be noted in FIGS. 3–5 that the upper edge portions of the inner pan unit front 50 and aft end walls, together with its side walls 55, terminate in associated upwardly extending convex or half-round lip portions 60, 60', and 61—61, respectively. The lip portions direct the return oil flow into the chamber 29 and, upon the chamber being filled, the lip portions provide a smooth path for the overflow oil into the inner pan unit reservoir 28.

FIGS. 3 and 4 show the pan assembly outer front end wall 50 upper edge portion formed with a forward projecting front concave cradle portion 80 and its outer aft end wall 50' formed with a rearward projecting, aft concave cradle portion 82. The front 80 and aft 82 cradle portions are aligned on the longitudinal axis of the pan assembly 10 to receive, in juxtaposed conformity, engine crankshaft 24. It will be seen in FIG. 5 that the aft cradle portion 82 has a greater depth below the side wall lip portions 61 than the front cradle portion 80 for accommodating an increased diameter portion of the crankshaft 24 adjacent the aft outer end wall 50'.

Referring to FIGS. 3 and 5, the inner unit front 51 and aft 51' end walls are each provided with concave depressions formed in their associated lip portions 60 and 60', and match front 80 and aft 82 concave cradles providing clearance for crankshaft 24. As seen in FIG. 4, the inner end wall aft concave lip portion 60' creates a lowermost point "Y" that is deeper than the front concave lip portion 60 point "X". With the engine turned off, the chamber inner aft end wall 51' attains a static oil level 70' determined by the lowermost point "Y". Upon turning the engine on, the chamber fills with return oil from the static oil level 70' to dynamic overflow oil level 70 along the side walls 54, 55. This fluctuation in the oil levels provides a re-circulation of the chamber oil thereby obviating a stagnation condition.

With reference to FIGS. 4 and 4A, the drain plug 47 is threaded into a drain hole 62 in outer sump area 48 and a drain hole 64 in inner sump area 49, thus sealing pan-shaped oil chamber 29 and inner pan unit reservoir 28. Removal of the drain plug 47 allows oil to flow out of chamber 29 and the inner pan unit reservoir 27.

FIG. 4B shows a modified drain plug 47' providing a threaded portion 65, threaded in a drain hole 66 in outer sump area 48, and an a cylindrical dowel stopper portion, aligned on free end of plug threaded portion 65, received in smooth drain hole 68. Upon removal of the drain plug 47' both the inner pan unit reservoir 28 and the oil chamber 29 are drained.

While the best modes for carrying out the invention have been described in detail, those skilled in the art in which this invention relates will recognize various alternative designs and embodiments, including those mentioned above, in practicing the invention that has been defined by the following claims.

What is claimed is:

1. An oil pan assembly for the lubrication system of a vehicle internal combustion engine having an engine block formed with oil return passage means, the oil pan assembly comprising; outer and inner pan units having substantially complementary upstanding wall means and bottom wall means, the inner unit of a predetermined reduced size supported in spaced fixed relation within the outer unit forming an oil capturing chamber between the units, the upper edge portions of the each outer and inner upstanding wall means defining there-between an inflow gap, such that upon the pan assembly being secured to the bottom of the engine block, the inflow gap is positioned subjacent one or more engine block return oil passage means and, with the engine running, a portion of the return oil flow exiting the passage means fills the chamber, whereby the captured chamber oil reduces engine noise radiating from the oil pan assembly.

2. The oil pan assembly as set forth in claim 1 wherein each pan unit upstanding wall means comprising a pair of opposed side walls and a pair of opposed end walls which, together with the bottom wall, provide a generally rectangular box-like, open top dual walled structure forming a generally pan-shaped oil chamber there-between such that, with the engine running, a portion of the return oil flow is captured in the chamber, whereby upon the chamber oil level reaching a predetermined dynamic overflow level the return oil flows into the inner unit reservoir for re-circulation to the engine.

3. The oil pan assembly as set forth in claim 2 wherein the outer pan unit has each side wall upper edge portion formed with an outboard directed flange means adapted to be secured to the bottom of the engine block.

4. The oil pan assembly as set forth in claim 1 wherein the inner pan unit upstanding wall means upper edge portion in the form of an upwardly facing convex curved lip for directing the return oil exiting the engine block passage means into the chamber, and upon the chamber being filled with oil, the side wall means curved lip directing the return oil overflow into the inner pan unit reservoir.

5. The oil pan assembly as set forth in claim 1 wherein the outer pan unit bottom wall means has a first threaded drain hole therein aligned with a second threaded drain hole in the inner pan unit bottom wall means, wherein the drain holes are adapted to receive a threaded screw-in drain plug sealing both the outer and inner pan unit bottom wall mean holes, whereby upon the drain plug being unthreaded and removed to change oil, both the inner pan unit reservoir and the oil chamber are drained by gravity flow.

6. The oil pan assembly as set forth in claim 1 wherein the outer pan unit bottom wall means has a first threaded drain hole therein aligned with a second drain hole in the inner pan unit bottom wall means, such that the threaded drain hole is adapted to receive a threaded portion of a screw-in drain plug and the overlying drain hole adapted to receive a cylindrical guide portion aligned on the free end of the plug threaded portion whereby, upon the drain plug being unthreaded and removed to change oil, both the inner pan unit oil reservoir and the oil chamber are drained by gravity flow.

7. The oil pan assembly as set forth in claim 1 wherein the outer and inner pan units are suitably secured together in uniform spaced relationship by spacer means.

8. The oil pan assembly as set forth in claim 7 wherein the outer and inner pan units are formed of sheet steel providing a rigid honeycomb-type dual walled structure having a weight comparable to a single walled sheet steel oil pan of like capacity.

9. The oil pan assembly as set forth in claim 1 wherein an upper edge portion of the inner wall means formed with a lowermost depressed portion wherein, with the vehicle engine turned off, the depressed portion establishing a lowermost static oil level, whereby with the engine turned on the chamber fills with return oil from its static level to its dynamic overflow level, whereby the repeated fluctuations in the chamber oil levels provides re-circulation of the chamber oil thereby obviating a stagnation condition.

10. A method for reducing the engine noise radiating from an internal combustion engine oil pan assembly, an engine block formed with gravity flow passage means for returning oil to the oil pan assembly secured to the bottom of the block, feed passage means in the block through which a pump supplies pressurized oil from the pan to a cylinder head secured to the top of the block, the method comprising:

forming outer and inner oil pan units, with the pan units defining upstanding opposed wall means, and opposed bottom wall means, the inner unit having a reduced size relative to the outer unit that conforms generally to the shape of the outer unit;

supporting the inner unit within the outer unit in a spaced nested manner, defining an oil capturing chamber between the units, the inner pan unit providing a oil reservoir, and the opposed upper edge portions of the upstanding wall means defining a return oil inflow gap there-between; and securing the oil pan assembly on the bottom of the engine block such that, with the engine running, the chamber oil inflow gaps being located subjacent gravity flow oil exiting the block return passage means thereby filling the chamber with oil, and wherein subsequent return oil flow by-passing the filled chamber and over flowing into the inner unit reservoir for re-circulation to the engine, whereby the oil filled chamber reduces engine noise radiating from the oil pan assembly.

* * * * *